US008299991B2

(12) United States Patent
Boiko

(10) Patent No.: US 8,299,991 B2
(45) Date of Patent: Oct. 30, 2012

(54) DISPLAY DRIVER METHOD AND APPARATUS

(75) Inventor: Evgueni Boiko, Surrey (GB)

(73) Assignee: Chimei Innolux Corporation, Chu-Nan (TW)

( * ) Notice: Subject to any disclaimer, the term of this patent is extended or adjusted under 35 U.S.C. 154(b) by 975 days.

(21) Appl. No.: 12/346,605

(22) Filed: Dec. 30, 2008

(65) Prior Publication Data

US 2009/0167749 A1 Jul. 2, 2009

Related U.S. Application Data

(60) Provisional application No. 61/017,809, filed on Dec. 31, 2007.

(30) Foreign Application Priority Data

Sep. 3, 2008 (EP) ..... 08163613

(51) Int. Cl.
*G09G 3/36* (2006.01)

(52) U.S. Cl. ..... 345/87; 345/89

(58) Field of Classification Search ..... 345/87–100, 345/204

See application file for complete search history.

(56) References Cited

U.S. PATENT DOCUMENTS 4,888,599 A * 12/1989 Harwood et al. ..... 345/89
5,664,158 A 9/1997 Larimer
2005/0225525 A1* 10/2005 Wu et al. ..... 345/89
2006/0044242 A1 3/2006 Park et al.
2007/0285366 A1* 12/2007 Ha et al. ..... 345/87

FOREIGN PATENT DOCUMENTS

| | | |
|---|---|---|
| EP | 1486945 | 12/2004 |
| EP | 1729280 | 12/2006 |
| WO | 2004/109371 | 12/2004 |
| WO | 2005/101367 | 10/2005 |
| WO | 2006/063448 | 6/2006 |
| WO | 2007/026714 | 3/2007 |

OTHER PUBLICATIONS

Yang, Cheng-Chien, "Novel Algorithm for LCD Color and Gray Level Response Time Adjustment", Electronic Thesis or Dissertation from National Taiwan University of Science & Technology, pp. 1-4.

* cited by examiner

*Primary Examiner* — Regina Liang
(74) *Attorney, Agent, or Firm* — Liu & Liu

(57) ABSTRACT

A method of providing an LCD overdrive drive scheme, which comprises measuring a stabilized transmission level of an LCD display pixel corresponding to a target drive level. An overdrive transmission level is measured corresponding to an overdrive drive level. The measured overdrive transmission level is compared with the measured stabilized transmission level to determine if the overdrive drive level is too high or too low. An iterative process then changes the overdrive drive level until a suitable overdrive drive level is found. This is used to derive overdrive drive scheme parameters which are stored in a memory of the LCD device. This method enables an overdrive scheme to be determined during use of the device. It can therefore take account of temperature and display ageing, without the effects of these being modeled.

20 Claims, 3 Drawing Sheets

DISPLAY DRIVER METHOD AND APPARATUS

CROSS REFERENCE TO RELATED APPLICATIONS

This application claims the benefit of U.S. Provisional Application No. 61/017,809 filed Dec. 31, 2007 and claims priority of European Patent Application No. 08163613.6 filed on Sep. 3, 2008, the entirety of which are incorporated by reference herein.

BACKGROUND OF THE INVENTION

1. Field of the Invention

The invention relates to a driver for driving the pixels of a display panel. The invention also relates to a display module comprising such a driver, an apparatus comprising such a display module and a method of providing an LCD overdrive drive scheme.

2. Description of the Related Art

LCD display modules are increasingly used for displaying motion pictures and TV signals. Fast moving objects within a picture are a challenge to an LCD display module.

The reason is the response time of the pixels of an LCD display module to a required change in luminance. An overdrive technique is known to improve the response time.

Without overdrive, when a luminance change of a pixel is required, a drive voltage is applied to the pixel such that a desired luminance will be reached in the end. The luminance of the pixel gradually changes from a starting luminance to the desired luminance. If motion pictures or TV signals have to be displayed, the required change in luminance needs to be achieved within a short time period, the so-called frame period. The frame period is the duration during which a single image of a motion picture or TV signal is supplied to the display module. During the frame period, all the pixels of the display panel are addressed once to receive a drive voltage.

When applying the drive voltage, necessary for achieving the desired luminance to the pixel, the actual luminance of the pixel lags behind the desired luminance, due to the inertia of the pixel. It may take several addressing periods until the desired luminance is achieved, causing blurred edges or ghost images.

To shorten the response time of a pixel, an overdrive voltage is applied. The level of the overdrive voltage exceeds the level of the drive voltage required to obtain the desired luminance in the end, and thus targets an overdrive luminance exceeding the desired luminance. When applying the overdrive voltage it usually takes several addressing periods until the overdrive luminance would be achieved. However, when the overdrive voltage is selected carefully, the luminance achieved at the end of a single addressing period is equal to the desired luminance.

Overdrive is recognized as a fundamental requirement for an AMLCD when good motion fidelity is expected. Single-frame LC response at 60 Hz will not be sufficient in future because a number of driving schemes aimed at removing sample-and-hold motion artefacts rely on higher frame rates of 120 Hz or more, thus increasing the need for overdrive.

With an overdrive technique, the desired luminance is reached within one addressing period and thus the response time of the pixel is artificially increased. The overdrive voltage required to achieve the desired luminance depends on the required luminance change and the starting luminance, and further depends on other variables, for example, on the type of display module and the frame rate at which the display is operated. Therefore, the overdrive voltages usually are listed in Look Up Tables (LUTs).

Typically, a unique look-up table is needed for every AMLCD design and possibly adjustments are required batch to batch or even module to module. Furthermore the LUT must vary with ambient temperature and display frame rate if overdrive accuracy is to be maintained. At present, it is by no means clear how much overdrive inaccuracy is tolerable in many applications and therefore how much LUT data must be stored if a framerate-flexible and/or temperature-compensated system is to be implemented.

The standard approach to implementing overdrive is to measure LUT in the factory for each module design (batch, module) and store these in (EP)ROM in the AMLCD module or elsewhere in the system. This creates significant logistical challenges for the manufacturer and also forces a performance compromise because there is a need to trade off overdrive accuracy against the cost of ROM, temperature sensors etc. Thus, implementing overdrive as an integral part of an AMLCD module is a difficult logistical challenge for the module maker due to the specialist measurements that need to be performed for reach new module design, possibly each new batch coming off the production line or even individually for each module. This is in addition to the challenge of storing enough measurement data to ensure sufficiently accurate overdrive for the application. The latter is more important for portable devices where the intended operating temperature range is likely to result in the requirement for temperature compensated overdrive.

BRIEF SUMMARY OF THE INVENTION

According to the invention, there is provided a method of providing an LCD overdrive drive scheme, comprising:

(i) measuring a stabilized transmission level of an LCD display pixel of an LCD device when a target drive level has resulted in the stabilized transmission level;

(ii) measuring an overdrive transmission level of the display pixel at the end of a single frame after the application of an overdrive drive level;

(iii) comparing the measured overdrive transmission level with the measured stabilized transmission level to determine if the overdrive drive level is too high or too low;

(iv) if the overdrive drive level is too high or too low, changing the overdrive drive level and repeating steps (ii) and (iii) until a suitable overdrive drive level is found; and (v) using the suitable overdrive drive level found to derive overdrive drive scheme parameters and storing the parameters in a memory of the LCD device.

This method enables an overdrive scheme to be determined during use of the device. It can therefore take account of temperature and display ageing, without the effects of these being modeled. Thus, the invention avoids the need for the module maker to understand fully the overdrive characteristics and maintain LUT measurement capability. The logistical effort to supply the correct LUTs with each new product, product update, or product batch is avoided. The overdrive accuracy is also provided automatically across a range of temperatures and frame rates.

The measurements are comparative, which reduces the accuracy requirements for the measurements.

The method can be implemented automatically and periodically or continuously in the background as part of normal operation of the AMLCD module, in a robust and simple way.

Thus the logistical challenge is removed and a means to compensate for temperature variation is provided.

The transmission level can be measured by a light sensor (i.e. direct measurement) or derived from a measurement of LC capacitance (i.e. indirect measurement).

The LCD display pixel can comprise a dummy pixel (or row of pixels or multiple rows of pixels) of the LCD device. This means the method for deriving the overdrive parameters can be implemented without affecting the normal display function. Thus, the method can be performed during normal use of the display device as a background function using the dummy pixel(s).

The overdrive drive level can be determined to be too high if there is overshoot of the transmission level above a threshold which comprises the stabilized transmission level plus a predetermined amount. The overdrive drive level is determined to be too low if the transmission level is below the threshold. This enables a simple iterative process to be defined to look for the best overdrive level for the particular target drive level being tested. The suitable overdrive level can for example comprise the maximum overdrive drive level for which there is no overshoot above the threshold. The overdrive drive scheme parameters can comprise LUT parameters.

The invention also provides an LCD driver. The LCD driver comprises a processor, and a memory. The memory stores overdrive drive scheme parameters. The processor is adapted to control a display pixel and a measuring means to:

(i) measure a stabilized transmission level of the display pixel when a target drive level has resulted in the stabilized transmission level;

(ii) measure an overdrive transmission level of the display pixel at the end of a single frame after the application of an overdrive drive level;

(iii) compare the measured overdrive transmission level with the measured stabilized transmission level to determine if the overdrive drive level is too high or too low;

(iv) if the overdrive drive level is too high or too low, change the overdrive drive level and repeat steps (ii) and (iii) until a suitable overdrive drive level is found; and (v) use the suitable overdrive drive level found to derive overdrive drive scheme parameters for storage in the memory.

This driver can be used in an LCD device comprising a display panel and means for measuring a transmission level of an LCD display pixel.

The method of the invention can be implemented as a computer program.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides a method of providing an LCD overdrive drive scheme in which the suitable overdrive level is determined in use, and based on comparative measurements between the desired transmission level of the LC pixel and the transmission level provided by a sequence of test overdrive levels. This provides an iterative process for determining the suitable overdrive level, and which can compensate for temperature and frame rate without requiring detailed modeling of the effects of these parameters on the required overdrive scheme.

The method essentially provides overdrive drive scheme parameters, for example in the form of LUT values. The essence of the LUT measurement algorithm is explained with reference to FIGS. 1 and 2.

Figure 1:
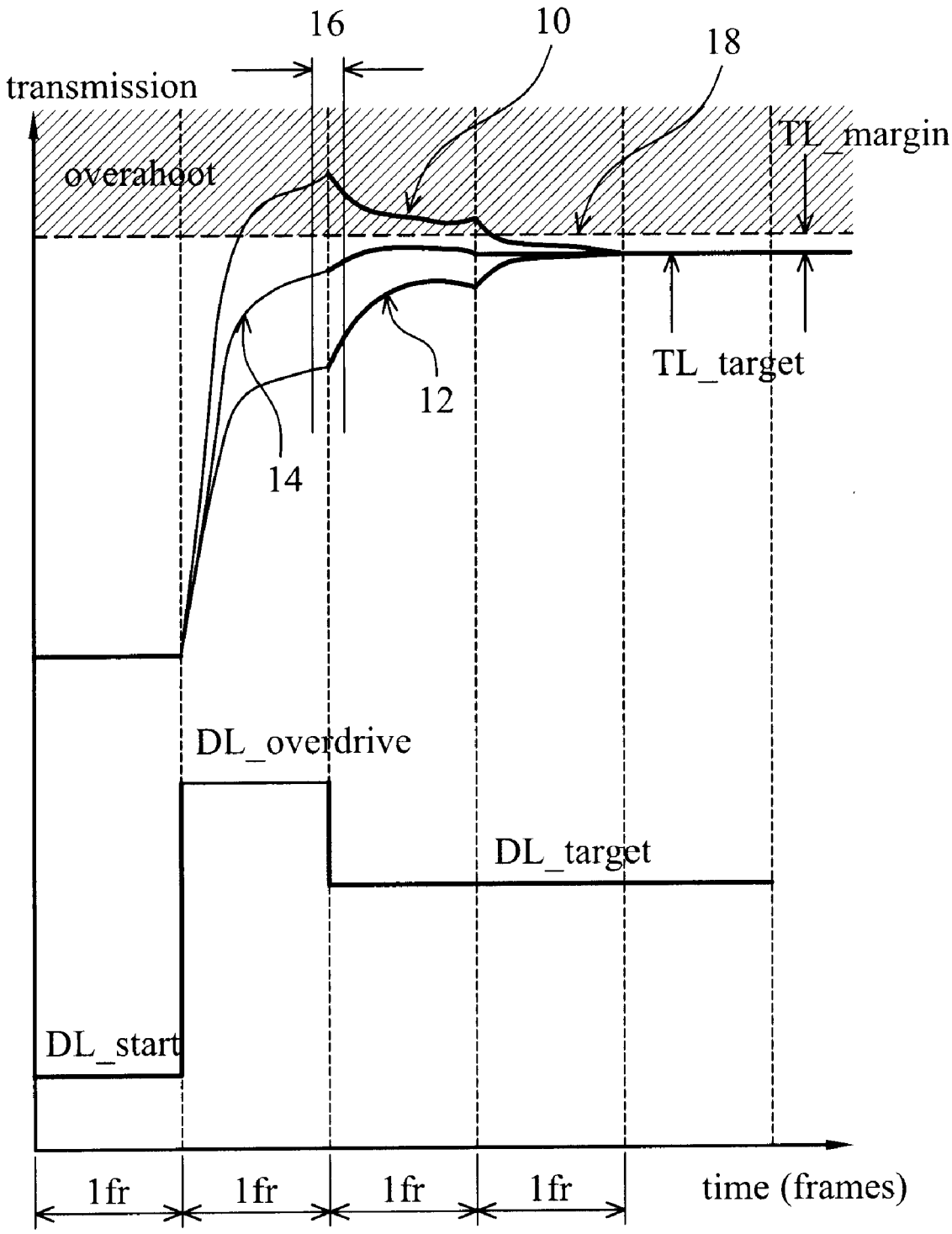
FIG. 1 shows pixel voltages and is used to explain the method of the invention.

FIG. 1 shows the voltage profile of a pixel voltage drive level "DL" as applied to the pixel when the gate line is turned on.

The drive level starts at a start value DL_start which represents the drive level during the previous frame, and is then held at an overdrive level DL_overdrive before being returned to the target level DL_target.

The first step of the process is to measure a stabilized transmission level of the LCD display pixel when the target drive level DL_target has resulted in the stabilized transmission level. The stabilized transmission level is shown as TL_target. This stabilized transmission level can for example be measured after the target drive level DL_target has been applied for a number of frames in succession.

An overdrive transmission level of the display pixel is then measured at the end of a single frame after the application of an overdrive drive level DL_overdrive. The overdrive level is selected as a test overdrive value, that is somewhere within the maximum possible overdrive range. This overdrive level can be too high, so that there is significant overshoot in the resulting pixel transmission as shown by plot 10, or it not be strong enough so that the pixel transmission is still slow to respond, as shown by plot 12. A good overdrive profile is shown by plot 14, as the transmission level at the end of the single frame period is close to the desired transmission level TL_target. The measurement interval is shown as region 16.

The measured overdrive transmission level, measured during time interval 16, is compared with the measured stabilized transmission level TL_target to determine if the overdrive drive level is too high (plot 10) or too low (plot 12).

The overdrive drive level is determined to be too high if there is overshoot of the transmission level above a threshold 18 which comprises the stabilized transmission level T_target plus a predetermined amount TL_margin (the value of TL_margin may be zero if it is desired that the reached brightness never exceeds the target brightness). The overdrive drive level is determined to be too low if the transmission level is below the threshold 18. In this way, a simply binary comparison can be implemented to determine if the measured transmission level is too high or too low.

A suitable overdrive level can be determined to be the one with the maximum overdrive level DL_overdrive for which there is no overshoot above the threshold 18.

To find this suitable level, an iterative process can be followed, in which the overdrive level is varied, as explained with reference to FIG. 2.

Figure 2:
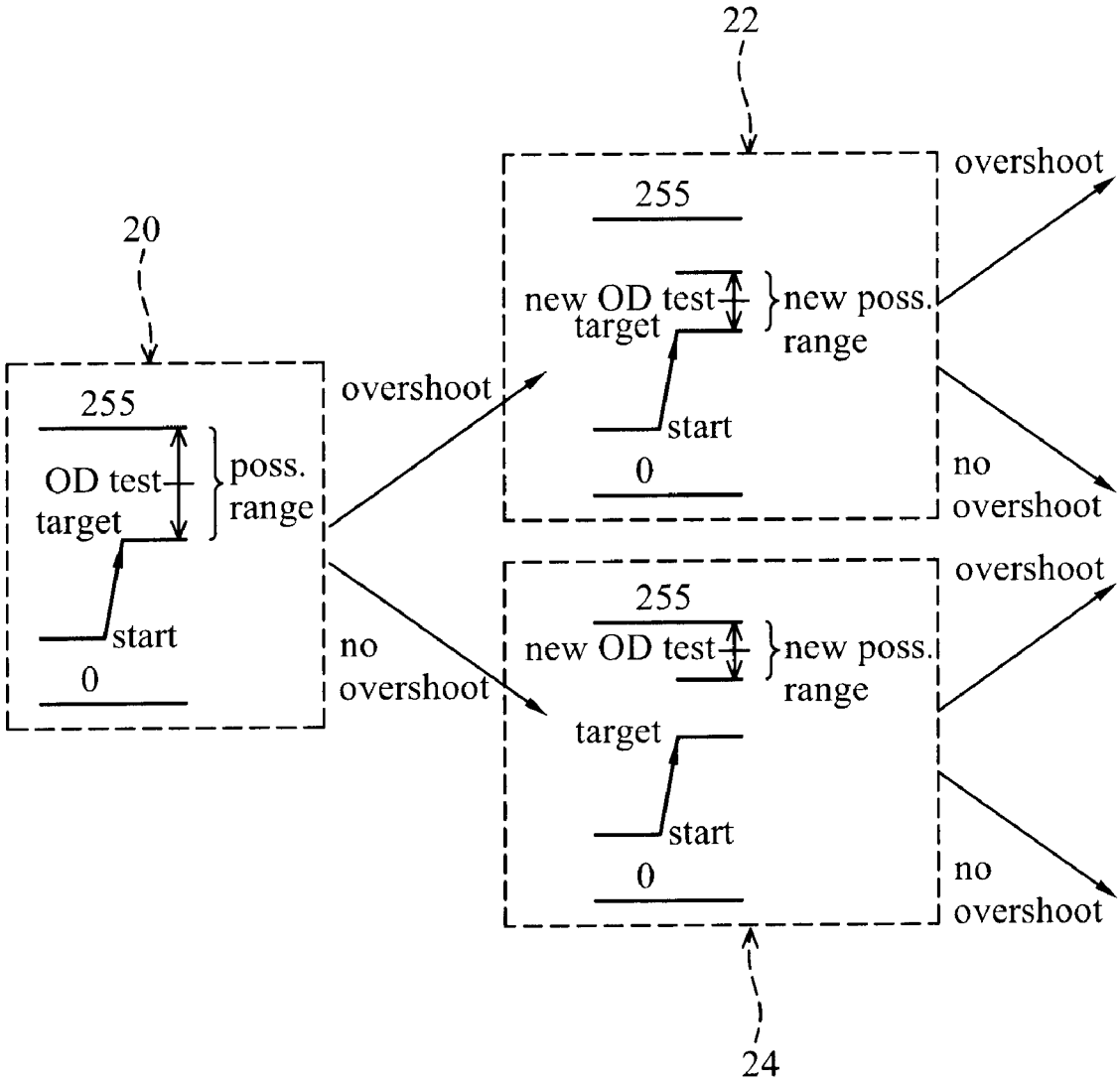
FIG. 2 is used to explain the iterative process of the method of the invention.

The left part 20 of FIG. 2 shows the first overdrive test after determining the target transmission level TL_target.

The overdrive applied is the value "OD test" and it can be anywhere within the permissible overdrive range "poss.range", for example in the middle of the range.

If overshoot is detected, the bottom part of the overdrive range, below the OD test value, becomes the new range. This is because the previous overdrive level was too high. This is shown in plot 22. The next overdrive test, "New OD test" is at the mid point of the bottom part of the range, as shown.

If no overshoot was detected in test 20, the top part of the overdrive range becomes the new range as shown in plot 24.

This process repeats iteratively until the final range is indivisible, and therefore contains just 1 grey level, i.e. the finest resolution of the overdrive signal DL_overdrive.

The end result is that the maximum overdrive level DL_overdrive is found for which there is no overshoot above the threshold 18.

The overdrive values can be used to form a LUT, which can then be applied in know manner. The LUT can provide overdrive levels for all start and finish transmission levels (i.e. all amounts of change in transmission level). This modeling can be achieved by obtaining suitable overdrive levels for all combinations of starting drivel level (DL_start) and target drive level (DL_target), or by extrapolating between a smaller set.

The use of a subset LUT obtained by overdrive measurement, together with interpolation is the preferred method. This is because it speeds up the measurement greatly. The overdrive LUT generally implements a smoothly varying surface function, so simple linear interpolation is sufficient to extrapolate between values, and this is inexpensive in terms of chip area. This also reduces EEPROM or RAM requirement since only the subset LUT needs be stored and the interpolation can be performed on power-up (so that there is a partial LUT in EEPROM and a full LUT in RAM). The interpolation can even be provided in real time.

Dummy pixels can be used for the test method. A single dummy pixel could be used, but preferably a plurality of pixels, for example a row of pixels or even multiple rows of pixels, are used. This enables multiple overdrive iterative measurements to be obtained in parallel.

The description given above relates to a most basic variant of the algorithm. This can be elaborated to achieve better efficiency, accuracy etc. For example, the measurements could be averaged to increase accuracy, previously recorded LUT values could be used to limit the logical starting range etc. Thus, the algorithm can make use of already measured LUT values in order to arrive more quickly at the values still to be measured. This can speed up the rest of the measurements taken. In the simplest case, the possible range "poss.range" can be narrowed down more using the information contained in a partially measured LUT or LUT subset. A more advanced algorithm could in addition generate better starting guesses of the overdrive value, instead of simply selecting the value in the middle of the range.

The derived LUT can be stored in RAM (regenerated on power-up each time) or EEPROM (in which case a relative or absolute temperature sensor would be appropriate to ensure that an incorrect LUT is not applied on power-up when e.g. the temperature at last power-down was significantly different). A combination approach is also possible depending on application requirements.

The method can be applied as a continuous background measurement. This results in overdrive that is continually adapting to the ambient temperature, thus removing the need for other means of temperature compensation. Continuously averaging the LUT values results in the accuracy of the LUT improving over time.

The transmission can be measured directly using a light sensitive element and the backlight, or indirectly by measuring the capacitance of the liquid crystal which relates in a known way to the transmission.

Figure 3:
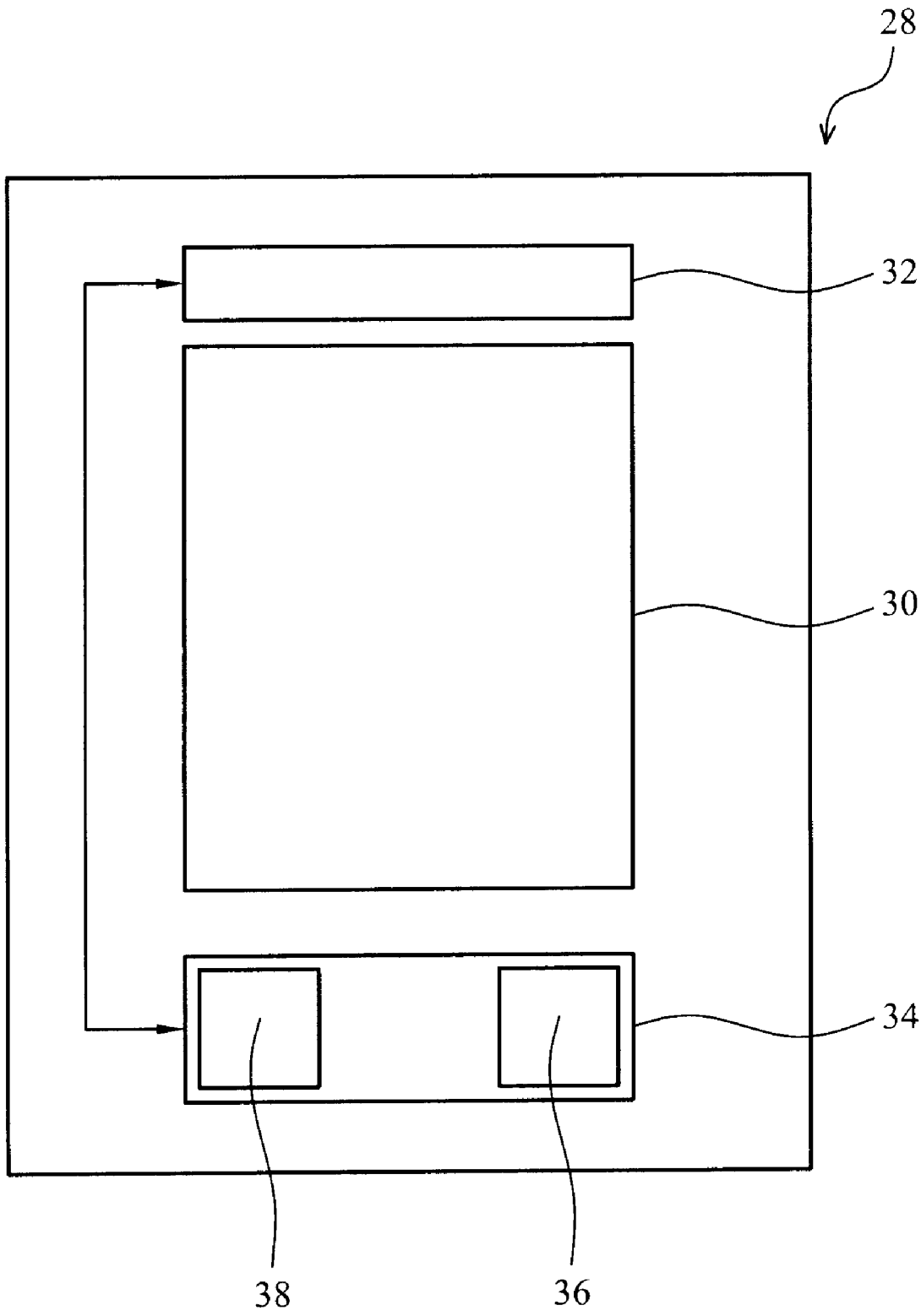
FIG. 3 shows the display driver and device of the invention.

FIG. 3 shows a system 28 of the invention, comprising an AMLCD having a display panel 30 with direct or indirect transmission sensing elements 32, connected via control and readout lines to a display driver integrated circuit 34 (x-Si, LTPS or other). The display driver circuit contains circuits that implement the overdrive, for example RAM and/or EEPROM memory 36 and circuits 38 that implement the algorithm described above for deriving the LUT to be stored in memory.

The transmission sensing elements 32 are associated with a dummy row or rows of pixels in this example.

The algorithm can be implemented by a processor which runs a computer program.

The algorithm can be implemented by routine hardware and software, and the transmission measurement can also be implemented using known techniques, for example using photodiodes for measuring a light level when a known backlight brightness is applied. The backlight can be segmented so that the part of the backlight behind the dummy pixels can be independently controlled. The light output from the dummy pixels can also be shielded from the viewer.

It is also possible to use normal pixels of the display for the overdrive algorithm, either as an operation during start-up or continuously during use of the display.

The invention is of particular interest for mobile devices, such as mobile phones, portable DVD payers. MP4 players, screens for automotive applications, laptops, and also for LCDTVs.

Various modifications will be apparent to those skilled in the art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of providing an LCD overdrive drive scheme, comprising:

(i) measuring a stabilized transmission level of an LCD display pixel of an LCD device when a target drive level has resulted in the stabilized transmission level;

(ii) measuring an overdrive transmission level of the display pixel at the end of a single frame after the application of an overdrive drive level;

(iii) comparing the measured overdrive transmission level with the measured stabilized transmission level to determine if the overdrive drive level is too high or too low, wherein the initial overdrive drive level is determined to be too high if there is overshoot of the measured overdrive transmission level above a threshold which comprises the stabilized transmission level plus a predetermined amount;

(iv) if the overdrive drive level is too high or too low, changing the overdrive drive level and repeating steps (ii) and (iii) until a suitable overdrive drive level is found; and (v) using the suitable overdrive drive level found to derive overdrive drive scheme parameters and storing the parameters in a memory of the LCD device.

2. A method as claimed in claim 1, wherein the transmission level is measured by a light sensor.

3. A method as claimed in claim 1, wherein the transmission level is derived from a measurement of LC capacitance.

4. A method as claimed in claim 1, wherein the LCD display pixel comprises a dummy pixel of the LCD device.

5. A method as claimed in claim 4, wherein the method is performed during normal use of the display device as a background function using the dummy pixel.

6. A method as claimed in claim 1, wherein the suitable overdrive drive level comprises a maximum overdrive drive level for which there is no overshoot above the threshold.

7. A method as claimed in claim 1, wherein the overdrive drive level is determined to be too low if the transmission level is below the threshold.

8. A method as claimed in claim 7, wherein the suitable overdrive drive level comprises the maximum overdrive drive level for which there is no overshoot above the threshold.

9. A method as claimed in claim 1, wherein the overdrive drive scheme parameters comprises LUT parameters.

10. A method as claimed in claim 9, wherein the LUT parameters comprises a subset LUT obtained by overdrive measurement and interpolation performed upon power-up.

11. A method as claimed in claim 1, wherein the overdrive drive level applied in step (ii) is selected taking into account existing overdrive drive scheme parameters.

12. A method as claimed in claim 1, wherein step (ii) comprises applying an initial overdrive test level selected between the target drive level and a maximum overdrive drive level, and subsequently applying a changed overdrive test level after determining if previous overdrive drive level is too high or low and changing the previous overdrive drive level in step (iv), wherein the changed overdrive drive level is selected in accordance with:

(a) if there is overshoot of the measured overdrive transmission level, changing previous overdrive test level to between the target drive level and previous overdrive test level, or (b) if there is no overshoot of the measured overdrive transmission level, changing the previous overdrive drive test level to between the previous overdrive test level and the maximum overdrive drive level.

13. A method as claimed in claim 12, wherein the overdrive test level is selected to be middle of a permitted range of drive levels.

14. An LCD driver, comprising:

a processor; and a memory for storing overdrive drive scheme parameters, wherein the processor is adapted to control a display pixel and a measuring device to:

(i) measure a stabilized transmission level of the display pixel when a target drive level has resulted in the stabilized transmission level;

(ii) measure an overdrive transmission level of the display pixel at the end of a single frame after the application of an overdrive drive level;

(iii) compare the measured overdrive transmission level with the measured stabilized transmission level to determine if the overdrive drive level is too high or too low, wherein the initial overdrive drive level is determined to be too high if there is overshoot of a transmission level above a threshold which comprises the stabilized transmission level plus a predetermined amount;

(iv) if the overdrive drive level is too high or too low, change the overdrive drive level and repeat steps (ii) and (iii) until a suitable overdrive drive level is found; and (v) use the suitable overdrive drive level found to derive overdrive drive scheme parameters for storage in the memory.

15. An LCD device comprising:

a display panel;

an LCD driver as claimed in claim 14; and a measuring device measuring a transmission level of an LCD display pixel.

16. A device as claimed in claim 15, wherein the LCD display pixel comprises a dummy pixel.

17. A device as claimed in claim 15, wherein the measuring device comprises a light sensor or an LC capacitance measurement device.

18. A device as claimed in claim 17, wherein the LCD display pixel comprises a dummy pixel.

19. A device as claimed in claim 14, wherein step (ii) comprises applying an initial overdrive test level selected between the target drive level and a maximum overdrive drive level, and subsequently applying a changed overdrive test level after determining if previous overdrive drive level is too high or low and changing the previous overdrive drive level in step (iv), wherein the changed overdrive drive level is selected in accordance with:

(a) if there is overshoot of the measured overdrive transmission level, changing previous overdrive test level to between the target drive level and previous overdrive test level, or (b) if there is no overshoot of the measured overdrive transmission level, changing the previous overdrive drive test level to between the previous overdrive test level and the maximum overdrive drive level.

20. A device as claimed in claim 19, wherein the overdrive test level is selected to be middle of a permitted range of drive levels.

* * * * *